US010167653B1

(12) United States Patent
Knudsen

(10) Patent No.: US 10,167,653 B1
(45) Date of Patent: Jan. 1, 2019

(54) FENCE PANEL SYSTEMS AND METHODS

(71) Applicant: N. Eric Knudsen, Maple Valley, WA (US)

(72) Inventor: N. Eric Knudsen, Maple Valley, WA (US)

( * ) Notice: Subject to any disclaimer, the term of this patent is extended or adjusted under 35 U.S.C. 154(b) by 0 days.

(21) Appl. No.: 15/908,679

(22) Filed: Feb. 28, 2018

Related U.S. Application Data

(63) Continuation of application No. 15/623,031, filed on Jun. 14, 2017, now Pat. No. 9,932,753.

(51) Int. Cl.
*E04H 17/16* (2006.01)

(52) U.S. Cl.
CPC ..... *E04H 17/16* (2013.01)

(58) Field of Classification Search
CPC .... E04H 17/16; E04H 17/1421; E04H 17/168
See application file for complete search history.

(56) References Cited

U.S. PATENT DOCUMENTS

| | | | |
|---|---|---|---|
| 3,454,262 | A | 7/1969 | Romano |
| 3,801,072 | A | 4/1974 | Newberry, Jr. |
| 4,809,955 | A | 3/1989 | Veilleux |
| 4,917,543 | A | 4/1990 | Cole et al. |
| 5,015,119 | A | 5/1991 | Schmanski |
| 5,078,367 | A | 1/1992 | Simpson et al. |
| 5,261,760 | A | 11/1993 | Castonguay et al. |
| 5,375,369 | A | 12/1994 | VerHoeve |
| 5,445,362 | A | 8/1995 | Reppert |
| 5,702,090 | A | 12/1997 | Edgman |
| 5,961,101 | A | 10/1999 | Anticole |
| D427,322 | S | 6/2000 | DeSouza |
| 6,226,934 | B1 | 5/2001 | Gaston |
| 6,398,193 | B1 | 6/2002 | DeSouza |
| D463,036 | S | 9/2002 | Petitt et al. |
| 6,478,287 | B2 | 11/2002 | DeSouza |
| 6,588,732 | B1 | 7/2003 | Caceres et al. |
| 6,913,249 | B1 | 7/2005 | Lerdu |
| 7,040,605 | B2 | 5/2006 | Lappen |
| 7,111,828 | B2 | 9/2006 | Rosine et al. |
| D549,468 | S | 8/2007 | Dessendorfer et al. |
| D608,056 | S | 1/2010 | Evans |
| 7,861,434 | B2 | 1/2011 | Knudsen |

(Continued)

FOREIGN PATENT DOCUMENTS

| | | |
|---|---|---|
| DE | 10 2007 023 501 A1 | 11/2008 |
| DE | 20 2012 012 273 U1 | 4/2013 |

(Continued)

*Primary Examiner* — Daniel J Wiley
(74) *Attorney, Agent, or Firm* — Seed IP Law Group LLP

(57) ABSTRACT

A fence panel is provided having a plurality of sub-panel assemblies positioned in a linear arrangement and coupled together via panel rails extending between opposing lateral ends of the fence panel. Each sub-panel assembly may include a plurality of fence boards coupled together by sub-panel rails that extend between opposing lateral ends of the sub-panel assembly. The panel rails may insertably receive a respective linear arrangement of the sub-panel rails. In addition, a respective sub-panel assembly spacer may be positioned between adjacent ones of the sub-panel assemblies to separate the sub-panel assemblies from each other. The fence panel may be provided in a kit consisting of a single packaged arrangement of fence panel components comprising or consisting of the sub-panel assemblies, sub-panel assembly spacers and the panel rails.

27 Claims, 7 Drawing Sheets

(56) References Cited

U.S. PATENT DOCUMENTS

| | | | |
|---|---|---|---|
| D638,955 | S | 5/2011 | Kopp et al. |
| 7,934,699 | B2 | 5/2011 | Zell et al. |
| 8,046,965 | B2 | 11/2011 | Rieber et al. |
| D665,098 | S | 8/2012 | Kopp et al. |
| D675,341 | S | 1/2013 | Cochrane |
| 8,511,648 | B2 | 8/2013 | McCarthy et al. |
| D697,230 | S | 1/2014 | Esposito |
| D713,546 | S | 9/2014 | Murray |
| D717,471 | S | 11/2014 | Donnelly et al. |
| 9,149,894 | B2 | 10/2015 | Richison et al. |
| 9,506,270 | B2 | 11/2016 | Knudsen |
| 2002/0011594 | A1 | 1/2002 | DeSouza |
| 2002/0020834 | A1 | 2/2002 | Stusser |
| 2004/0140461 | A1 | 7/2004 | Lappen |
| 2004/0206946 | A1 | 10/2004 | Lappen |
| 2004/0206948 | A1 | 10/2004 | Lappen |
| 2006/0113517 | A1 | 6/2006 | Colantonio et al. |
| 2007/0209318 | A1 | 9/2007 | McCarthy |
| 2007/0224885 | A1 | 9/2007 | McCarthy |
| 2007/0251179 | A1 | 11/2007 | McCarthy |
| 2007/0278468 | A1 | 12/2007 | Zacarias et al. |
| 2008/0179580 | A1 | 7/2008 | McGinness et al. |
| 2009/0078923 | A1 | 3/2009 | McGinness et al. |
| 2009/0152523 | A1 | 6/2009 | Erwin |
| 2009/0282770 | A1 | 11/2009 | Rieber et al. |
| 2010/0096608 | A1 | 4/2010 | McCarthy et al. |
| 2010/0200825 | A1 | 8/2010 | Hill |
| 2011/0233496 | A1 | 9/2011 | Caruso |
| 2013/0153843 | A1 | 6/2013 | Leach |
| 2013/0320281 | A1 | 12/2013 | Richison et al. |
| 2013/0328001 | A1 | 12/2013 | McCarthy et al. |
| 2015/0041743 | A1 | 2/2015 | Richison et al. |

FOREIGN PATENT DOCUMENTS

| | | | |
|---|---|---|---|
| FR | 1.572.217 | A | 6/1969 |
| FR | 2 887 911 | A1 | 1/2007 |
| FR | 2 983 895 | A1 | 6/2013 |
| JP | D1060445 | S | 2/2000 |
| JP | D1060447 | S | 2/2000 |
| JP | D1060449 | S | 2/2000 |
| JP | D1060450 | S | 2/2000 |

FENCE PANEL SYSTEMS AND METHODS

BACKGROUND

Technical Field

The present disclosure is related to fences, fence panels, modular components and kits for forming fence panels and related methods.

Description of the Related Art

Fences are available in a variety of designs. In some cases, a fence can include fence posts and fence panels supported by and spanning between adjacent fence posts. Some fence panels are generally opaque structures, while others include lattice components for aesthetic or functional purposes. Some fence panels can be assembled on-site at an installation location, while others can be pre-fabricated and transported to an installation location. Many currently available fence panels are time-consuming and expensive to construct, and/or are too bulky or large to transport easily.

BRIEF SUMMARY

Embodiments of the fence panel systems, components and related methods disclosed herein enable fence panels to be constructed efficiently and with precision, thus reducing costs and improving quality.

According to one example embodiment, a fence panel may be summarized as including: a plurality of sub-panel assemblies positioned in a linear arrangement, each sub-panel assembly including a plurality of fence boards coupled together in series by a plurality of sub-panel rails that extend between opposing lateral ends of the sub-panel assembly; a respective sub-panel assembly spacer positioned between adjacent ones of the sub-panel assemblies that separate the sub-panel assemblies from each other; and a plurality of panel rails, each panel rail insertably receiving a respective linear arrangement of the sub-panel rails formed by the linear arrangement of sub-panel assemblies.

Each of the panel rails may include an elongate cavity having a cross-sectional profile that is sized and shaped to insertably receive the respective linear arrangement of the sub-panel rails. For example, in some instances, the elongate cavity may be formed in a face of the panel rail to provide a panel rail having a cross-sectional profile that is generally U-shaped to mate with a corresponding shape of the sub-panel rails.

In some instances, the fence boards of each sub-panel assembly may be positioned next to each other in a non-overlapping manner. In other instances, the fence boards of each sub-panel assembly may be positioned next to each other in an overlapping manner. The fence boards of each sub-panel assembly may be secured together via the sub-panel rails and a plurality of fasteners (e.g., nails, screws) extending through an interface between the fence boards and the sub-panel rails. In some instances, the fasteners may not protrude through exterior faces of the fence boards.

Each sub-panel assembly spacer may include a protruding portion that physically separates adjacent sub-panel assemblies from each other. Each sub-panel assembly spacer may be configured, for example, to abut a respective exterior face of each of adjacent end fence boards of the adjacent sub-panel assemblies at a mating interface, and the protruding portion of the sub-panel assembly spacer may protrude a distance from the mating interface that is less than a thickness of the adjacent end fence boards. In other instances, the protruding portion may extend the entire thickness of the adjacent end fence boards to abut the panel rails. The cross-sectional profile of the sub-panel assembly spacer may have a variety of shapes, including, for example, a generally T-shape. The sub-panel assembly spacer may extend an entire or substantially an entire height of the fence panel or an entire or substantially an entire height of adjacent fence boards.

According to one particularly advantageous embodiment, the fence panel is constructible from a kit consisting of a single packaged arrangement of the sub-panel assemblies, the sub-panel assembly spacers and the panel rails.

According to one embodiment, a fence panel kit for constructing a fence panel to be installed between adjacent fence posts may be summarized as including: one or more packaged arrangements of fence panel components that include a plurality of sub-panel assemblies each having a plurality of fence boards coupled together in series by a plurality of sub-panel rails, a plurality of sub-panel assembly spacers and a plurality of panel rails, each of the sub-panel assemblies, the sub-panel assembly spacers, and the panel rails being disconnected from one another for storage and transport in the one or more packaged arrangements. The fence panel components may be constructible into a fence panel in which adjacent sub-panel assemblies are separated by a respective one of the sub-panel assembly spacers and in which the sub-panel rails are received within the panel rails.

In some instances, the fence panel kit may consist of a single packaged arrangement, and the fence components may be arranged within a rectangular reference prism having a width equal to a width of the sub-panel assemblies. The rectangular reference prism may also have a height equal to a length of the panel rails and a depth equal to a collective thickness of one of the panel rails, two of the sub-panel assemblies and two fence boards of the sub-panel assemblies.

According to another aspect of the present invention, a method of constructing a fence panel may be summarized as including assembling a fence panel from a plurality of fence panel components including a plurality of sub-panel assemblies, a plurality of sub-panel assembly spacers, and a plurality of panel rails, wherein each sub-panel assembly includes a plurality of fence boards coupled together in series by a plurality of sub-panel rails extending between opposing lateral ends of the sub-panel assembly. The assembling may include: arranging the plurality of sub-panel assemblies in a linear arrangement with a respective sub-panel assembly spacer between adjacent sub-panel assemblies and with the sub-panel rails from each sub-panel assembly aligned in linear arrangements; positioning each panel rail to insertably receive a respective linear arrangement of the sub-panel rails of the sub-panel assemblies; and securing the panel rails to the sub-panel assemblies.

Securing the panel rails to the sub-panel assemblies may include fastening the panel rails to the fence boards and/or the sub-panel rails of the sub-panel assemblies. Positioning each panel rail to insertably receive a respective linear arrangement of the sub-panel rails of the sub-panel assemblies may include readjusting one or more of the plurality of sub-panel assemblies relative to the panel rail such that each of the sub-panel rails align with a cavity formed in the panel rail. Each panel rail may include an elongate cavity having a cross-sectional profile that is sized and shaped to insertably receive the sub-panel rails, and positioning each panel rail to insertably receive the respective linear arrangement of sub-panel rails may include nesting the sub-panel rails within the elongate cavity of the panel rail. The method may further include securing the panel rails to the sub-panel assembly spacers with a gap provided therebetween. In some instances, the fence panel may be assembled to include an exterior face, and assembling the fence panel may be completed without extending a fastener through the exterior face.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures, features, devices and techniques associated with fences and fence construction have not been shown or described in detail to avoid unnecessarily obscuring descriptions of the embodiments. For example, although not illustrated in the Figures, it will be appreciated that embodiments of the fence panels described herein may be constructed with conventional fasteners, such as nails and/or screws, of suitable size and quantity to form a rigid fence structure. In addition, although example embodiments shown in the Figures may be described in some instances as wood fence panels, it is appreciated that fence panels may be formed of other materials, such as metal or vinyl, and that aspects of the embodiments described herein may be modified accordingly.

Figure 1:
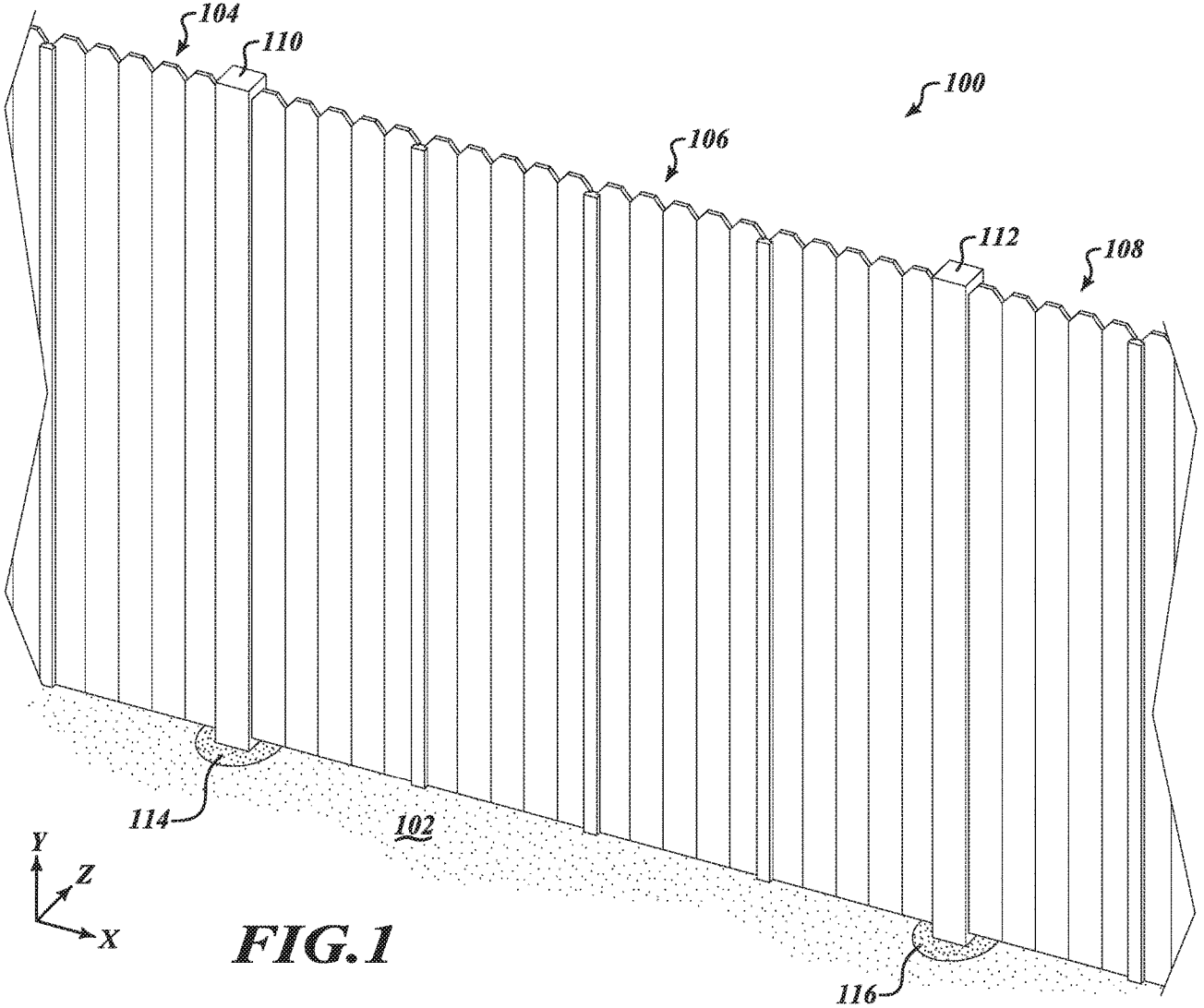
FIG. 1 is a front perspective view of a portion of a fence run including a plurality of fence panels constructed in accordance with embodiments of the present invention which are secured between fence posts extending from the ground.

FIG. 1 shows a portion of a fence 100 and more particularly a portion of an example wood fence. Fence 100 is a completed, assembled fence built to stand in and rise vertically from the ground 102. In different embodiments, the fence 100 can be built in various environments and the ground 102 can include different types of earth, dirt, soil, rock, etc. In some embodiments, the fence 100 may be supported above the ground 102, such as, for example, by fence post supports extending above the ground 102. Fence 100 includes a first fence panel 104, a second fence panel 106, and a third fence panel 108 all of similar construction. Fence 100 also includes a first fence post 110 and a second fence post 112. The fence posts 110, 112 are positioned and supported within respective fence post footings 114, 116 formed in the ground 102. The first fence panel 104 is supported at one end by the first fence post 110, the second fence panel 106 is supported by and spans between the first fence post 110 and the second fence post 112, and the third fence panel 108 is supported at one end by the second fence post 112. The fence panels 104, 106, and 108 can be coupled to the fence posts 110, 112 using nails, screws, bolts, or other mechanical fasteners and/or brackets or other fence hardware.

The second fence panel 106 has a length extending from a first lateral end of the second fence panel 106 (which is fixed to the first fence post 110) to a second lateral end of the second fence panel 106 (which is fixed to the second fence post 112) along a first dimension X, which can be horizontal and aligned with the direction in which the fence 100 runs. The second fence panel 106 also has a height extending from a top end of the second fence panel 106 to a bottom end of the second fence panel 106 along a second dimension Y, which can be vertical and perpendicular to the first dimension X. The second fence panel 106 also has a width extending from a first major surface or side of the second fence panel 106 visible in FIG. 1 (e.g., a "front" of the fence panel 106) to a second major surface or side of the second fence panel 106 not visible in FIG. 1 (e.g., a "back" or "rear" of the fence panel 106) along a third dimension Z, which can be horizontal and perpendicular to the first dimension X and the second dimension Y. Fence panels (e.g., fence panels 104, 106, 108) can have various dimensions, such as, for example, a length of 6 or 8 feet, a height of 3.0, 3.5, 4.0, 4.5, 5.75, or 6 feet, and a variety of widths.

Figure 2:
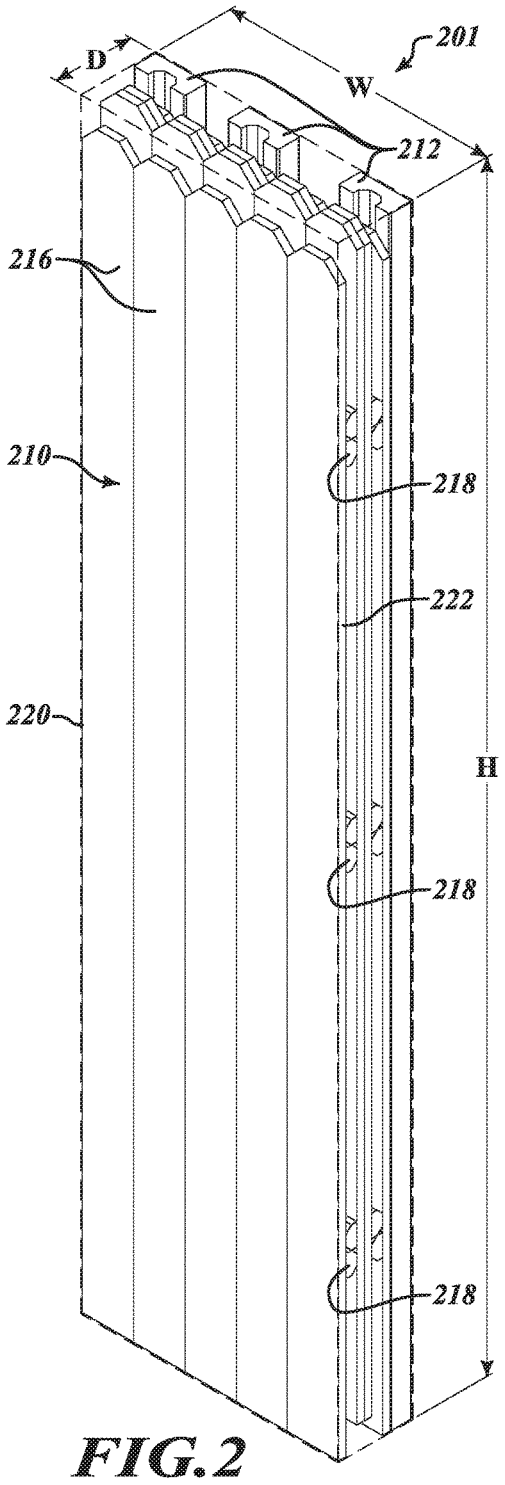
FIG. 2 is a front isometric view of a collection of fence components, according to one example embodiment, for constructing a fence panel to be installed between a pair of fence posts, such as the fence panels shown in FIG. 1.
Figure 3:
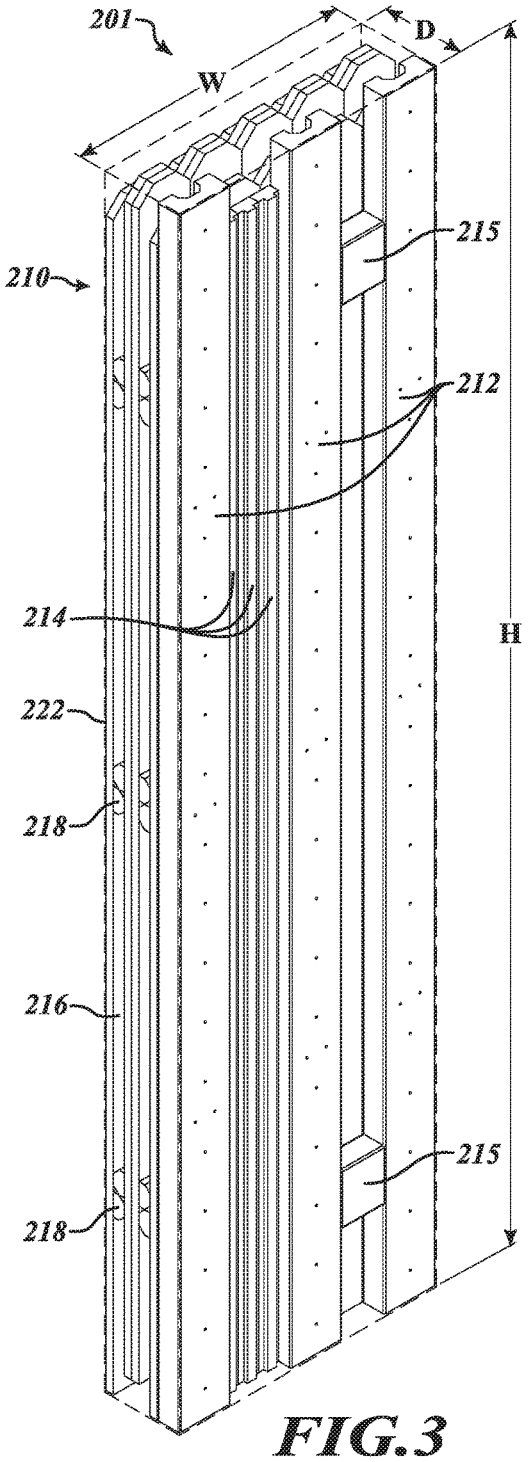
FIG. 3 is a rear isometric view of the collection of fence components of FIG. 2.
Figure 4:
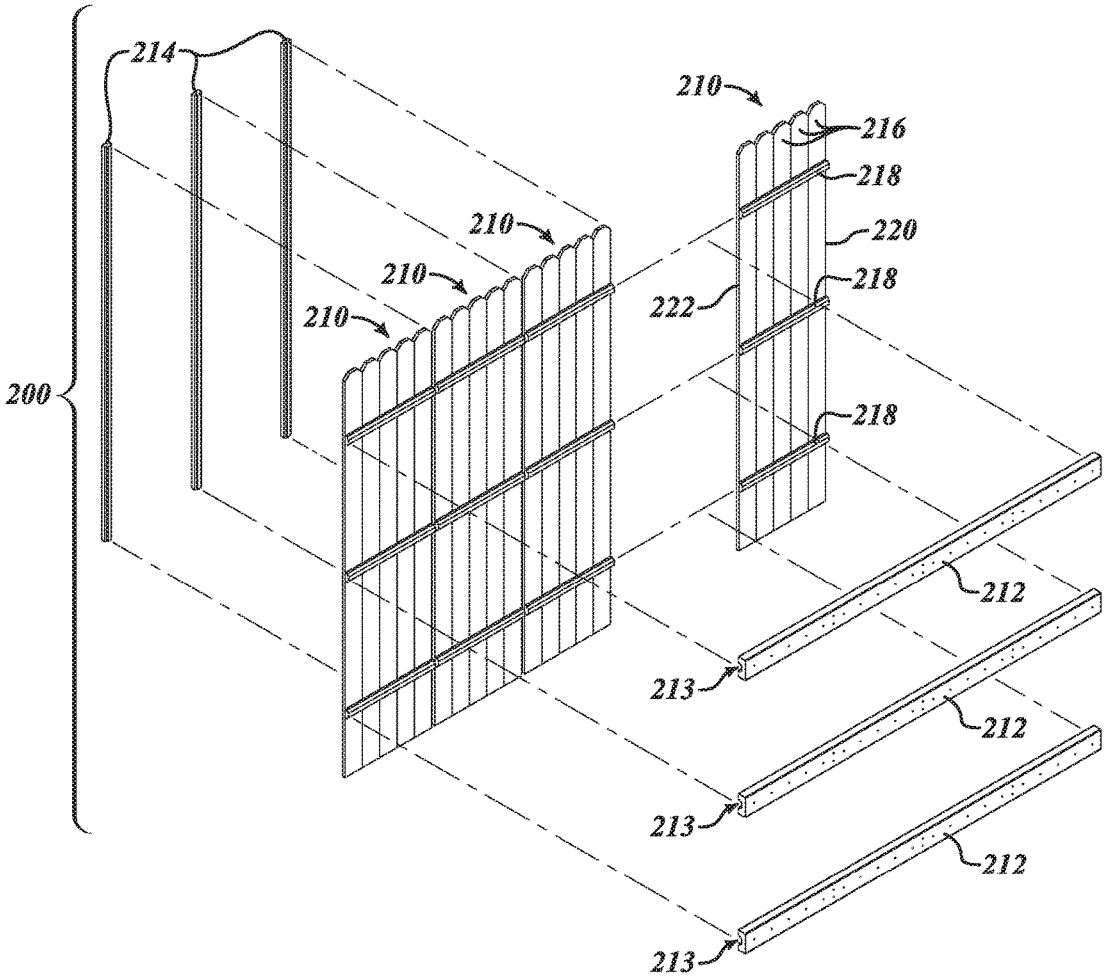
FIG. 4 is an isometric exploded view of the fence panel which is constructible from the collection of fence components shown in FIGS. 2 and 3.
Figure 5:
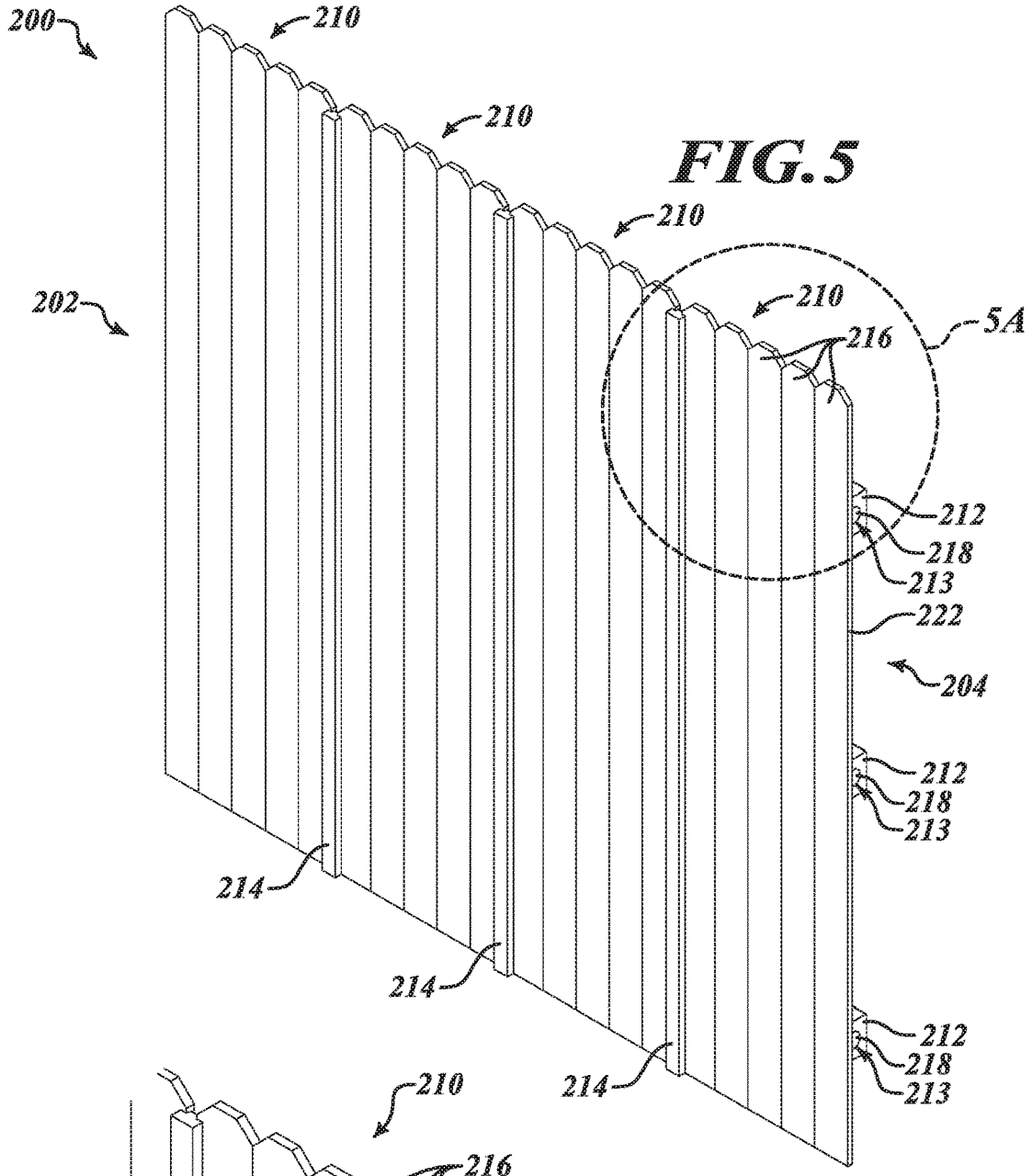
FIG. 5 is a front isometric view of the fence panel constructed from the collection of fence components shown in FIGS. 2 and 3.
Figure 5A:
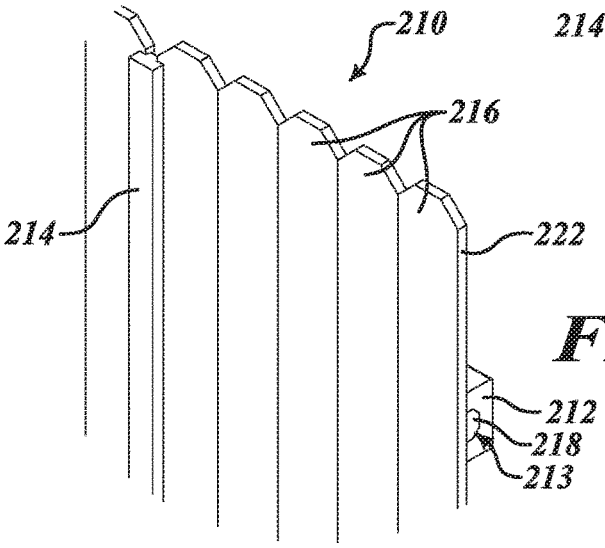
FIG. 5A is an enlarged detail view of a portion of the fence panel of FIG. 5.
Figure 6:
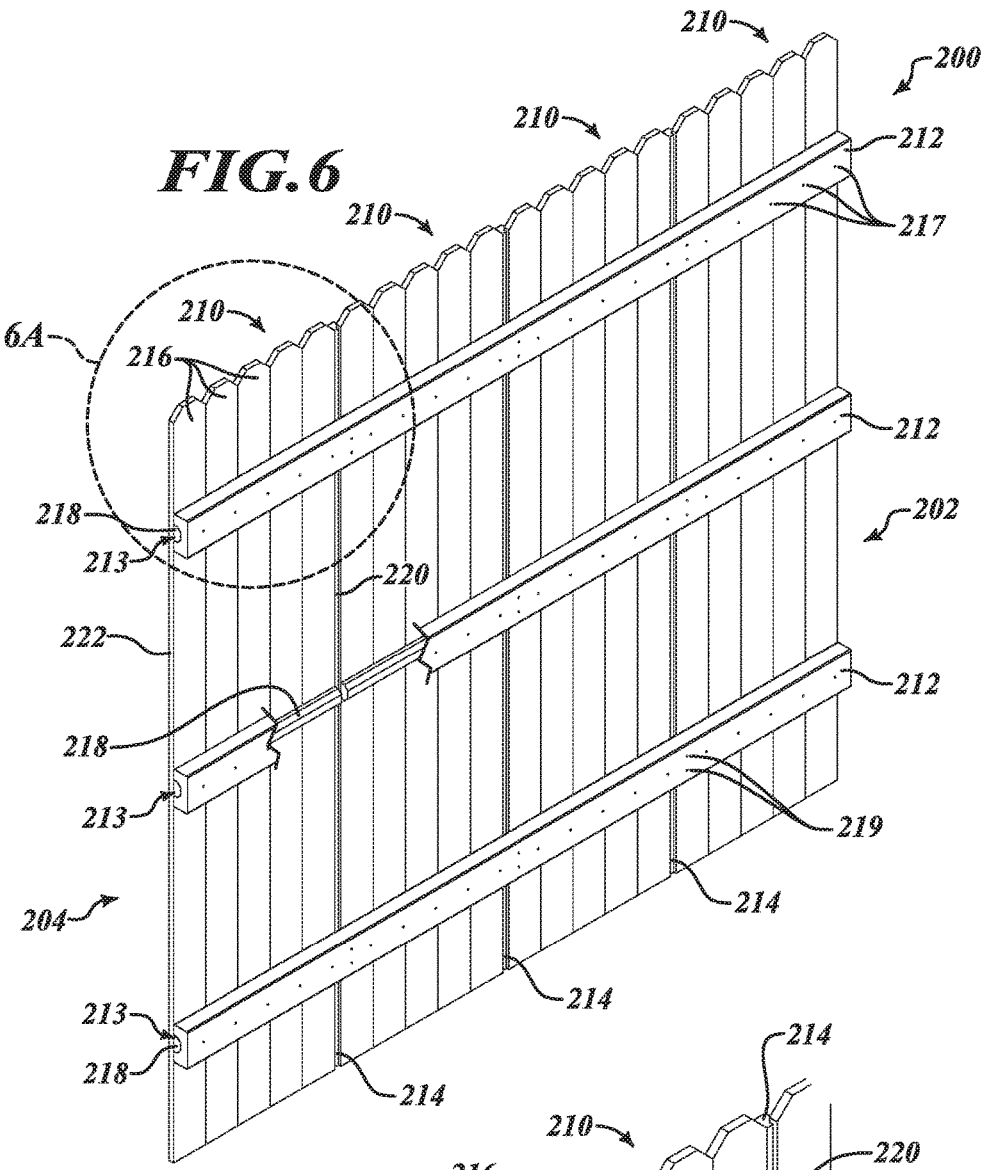
FIG. 6 is a rear isometric view of the fence panel constructed from the collection of fence components shown in FIGS. 2 and 3.

FIGS. 2 through 4 show various components of a fence panel 200 that can be used to form the fence panels 104, 106, and 108 of the fence 100 shown in FIG. 1. FIGS. 2 and 3 show the components in a densely packed arrangement 201 from opposing sides thereof, which is particularly well suited for storing and shipping the component parts of the fence panel 200, and FIG. 4 provides an exploded view of the components of the fence panel 200. The fence panel 200 of the example embodiment includes the following components: sub-panel assemblies 210; panel rails 212, and sub-panel assembly spacers 214. When the fence panel 200 is fully constructed, the plurality of sub-panel assemblies 210 are positioned in a linear arrangement and coupled together via the panel rails 212, which extend between opposing lateral ends 202, 204 of the fence panel 200, as shown in FIGS. 5 and 6. As can be appreciated from the exploded view of FIG. 4, each sub-panel assembly 210 (four shown) may include a plurality of vertical fence boards 216 (five shown) coupled together by horizontal sub-panel rails 218 (three shown for each sub-panel assembly) that extend between opposing lateral ends 220, 222 of the sub-panel assembly 210, and the panel rails 212 (three shown) may insertably receive a respective linear arrangement of the sub-panel rails 218. In addition, a respective sub-panel assembly spacer 214 (three shown) may be positioned between adjacent ones of the sub-panel assemblies 210 to separate the sub-panel assemblies 210 from each other.

In one particularly advantageous embodiment, the components of the fence panel 200 may be provided in a kit consisting of a single packaged arrangement comprising or consisting of the sub-panel assemblies 210, the panel rails 212, and the sub-panel assembly spacers 214, such as by enclosing or otherwise securing the collection of components shown in FIGS. 2 and 3 into a single package. In this manner, the components necessary to construct a complete fence panel 200 can be provided in a single, compact bundle that may be transported with ease. In some instances, the fence panel kit may consist of a single packaged arrangement and the fence components may be arranged within a rectangular reference prism having a width W equal to a width of the sub-panel assemblies 210. The rectangular reference prism may also have a height H equal to a length of the panel rails 212 and a depth D equal to a collective thickness of one of the panel rails 212, two of the sub-panel assemblies 210 and two fence boards 216 of the sub-panel assemblies 210, as shown, for example, in the densely packed arrangement 201 of FIGS. 2 and 3.

The components of the fence panel 200 may also include particular features or otherwise be configured to assist in efficiently constructing the fence panel 200 with precision. For example, with reference to FIG. 4, each of the sub-panel assemblies 210 may include a series of sub-panel rails 218 that are fastened to the fence boards 216 to hold the fence boards 216 together. The sub-panel rails 218 may be provided in regular or irregular spacing intervals along a height of the fence boards 216. The sub-panel assemblies 210 may be positioned next to each other in a linear series such that the sub-panel rails 218 of each sub-panel assembly 210 align with each other. In addition, a respective sub-panel assembly spacer 214 may be positioned between each adjacent pair of the sub-panel assemblies 210. Each of the panel rails 212 may then be positioned to insertably receive, or to otherwise engage or abut, the linear arrangements of the sub-panel rails 218 formed by the end-to-end linear arrangement of the sub-panel assemblies 210 to assist in ensuring the sub-panel assemblies 210 are properly aligned relative to each other and to assist in fixing the sub-panel assemblies 210 in space relative to each other. The panel rails 212 can then be fixed to the sub-panel assemblies 210 and to the sub-panel assembly spacers 214 by suitable fixing techniques, such as, for example, by driving fasteners (e.g., nails, screws) through the panel rails 212 into the sub-panel rails 218 and/or fence boards 216 of the sub-panel assemblies 210, and by driving fasteners (e.g., nails, screws) through the panel rails 212 into the sub-panel assembly spacers 214. For this purpose, each of the panel rails 212 may include an elongate rail cavity 213 having a cross-sectional profile that is sized and shaped to insertably receive the respective linear arrangement of the sub-panel rails 218. For example, in some instances, the elongate rail cavity 213 may be formed in a face of the panel rail 218 to provide a panel rail 218 having a cross-sectional profile that is generally U-shaped. According to the embodiment of the fence panel 200 shown in FIGS. 5 through 6A, each of the panel rails 212 may be provided by an elongate rail structure (such as a 2×4 fence rail) that has been machined or otherwise modified to include an elongate cavity 213. The cross-sectional profile of the elongate cavity 213 may be D-shaped, as shown in the figures, or of another shape that is complementary to an external profile of the sub-panel rails 218. In some instances, the sub-panel rails 218 and corresponding rail cavity 213 may have self-centering features, or may otherwise be shaped to closely nest with each other to assist in keeping the sub-panel assemblies 210 aligned with each other. In some embodiments, the sub-panel rails 218 and the panel rails 212 may be provided with interlocking features, such as, for example, male-female couplings (e.g., male fitting coupleable to female receiver) for engaging with each other. In some embodiments, the sub-panel rails 218 and the panel rails 212 may include a hooked interface or other interface (e.g., a dovetail joint interface) that enables the panel rails 212 to be readily secured to the sub-panel rails 218.

In some embodiments, the panel rails 212 may include apertures, indentations or markings that correspond to the preferred location of fasteners for securing the panel rails 212 to the sub-panel assemblies 210 and to the sub-panel assembly spacers 214. For example, with reference to FIG. 6, the panel rails 212 may include an arrangement of apertures, indentations or markings, such as, for example, an array of pilot holes 217 (five shown for each sub-panel assembly 210), that are provided for receiving fasteners, such as nails or screws, for securing the panel rails 212 to the sub-panel rails 218. The panel rails 212 may include a separate arrangement of apertures, indentations or markings, such as, for example, an array of pilot holes 219 (two shown for each sub-panel assembly 210), that are provided for receiving fasteners, such as nails or screws, for securing the panel rails 212 to the sub-panel assembly spacers 214. In some instances, all fasteners required for forming the fence panel 200 may be provided with the aforementioned kit of fence panel components.

Figure 6A:
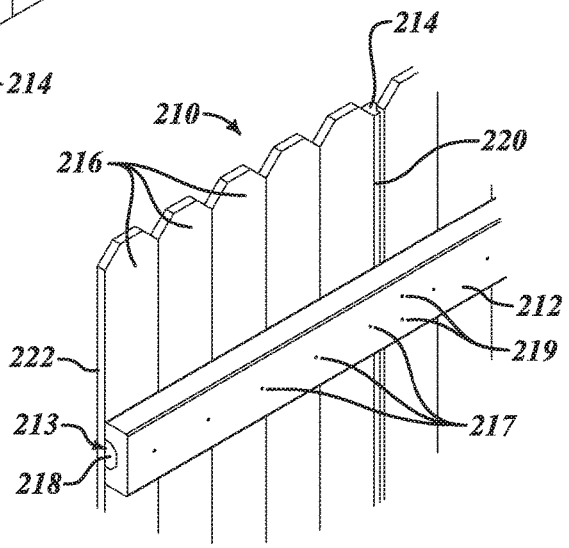
FIG. 6A is an enlarged detail view of a portion of the fence panel of FIG. 6.

In some embodiments, the fence boards 216 of each sub-panel assembly 210 may be positioned next to each other in a non-overlapping manner, as shown in the example embodiment of the fence panel 200 of FIGS. 5 through 6A. In other instances, the fence boards 216 of each sub-panel assembly 210 may be positioned next to each other in an overlapping manner, such as, for example, via tongue and groove connections between the fence boards 216. In such instances, a portion of each fence board 216 may be insertably received in an adjacent fence board 216 and may be interlocked therewith. The fence boards 216 of each sub-panel assembly 210 may be secured together via the sub-panel rails 218 and a plurality of fasteners (e.g., nails, screws) extending through an interface between the fence boards 216 and the sub-panel rails 218. When the fence boards 216 are provided with suitable depth, the fasteners may be driven from the side of the sub-panel rails 218 into the fence boards 216 to not protrude through exterior faces of the fence boards 216. In some instances, the sub-panel rails 218 may be secured to the fence boards 216 without mechanical fasteners, such as by using adhesives in lieu of such mechanical fasteners. In any event, the fence boards 216 of each sub-panel assembly 210 are fixedly attached to the sub-panel rails 218 to form sub-panel assemblies 210 that can be stacked and shipped, if desired, to other locations for subsequent construction of the fence panel 200.

With reference to the example embodiment of the fence panel 200 shown in FIGS. 5 through 6A, each sub-panel assembly spacer 214 may include a protruding portion that physically separates adjacent sub-panel assemblies 210 from each other when the fence panel 200 is fully constructed. Each sub-panel assembly spacer 214 may be configured, for example, to abut a respective exterior face of each of adjacent end fence boards 216 of the adjacent sub-panel assemblies 210 at a mating interface, and the protruding portion of the sub-panel assembly spacer 214 may protrude into a region between adjacent sub-panel assemblies 210 to physically separate the sub-panel assemblies 210. In some instances, the protruding portion of the sub-panel assembly spacer 214 may extend up to and terminate at the interface of the panel rails 212 with the fence boards 216. In other instances the protruding portion of the sub-panel assembly spacer 214 may extend a distance from the exterior face of fence boards 216 that is less than a thickness of the fence boards 216 to provide a gap or space between the sub-panel assembly spacer 214 and the panel rail 212 for aesthetic or other purposes. According to the example embodiment shown in FIGS. 5 through 6A, the cross-sectional profile of the sub-panel assembly spacer 214 is generally T-shaped; however, it is appreciated that the sub-panel assembly spacer 214 may have a variety of different cross-sectional shapes. In addition, the sub-panel assembly spacer 214 may be any of a variety of different widths and/or lengths. In some instances, the sub-panel assembly spacers 214 may extend an entire or substantially an entire height of the fence panel 200 or an entire or substantially an entire height of adjacent fence boards 216. Further, in some embodiments, the sub-panel assembly spacers 214 may be omitted altogether, and the sub-panel assemblies 210 may be positioned immediately adjacent each other with no intermediate structures.

Although the example embodiment of the fence panel 200 shown in FIGS. 5 through 6A includes a flat horizontal upper profile with dog-eared fence boards 216, it is appreciated that the fence boards 216 can vary in length, width, thickness, and/or end profile to provide a variety of different styles of fence panels.

Figure 7:
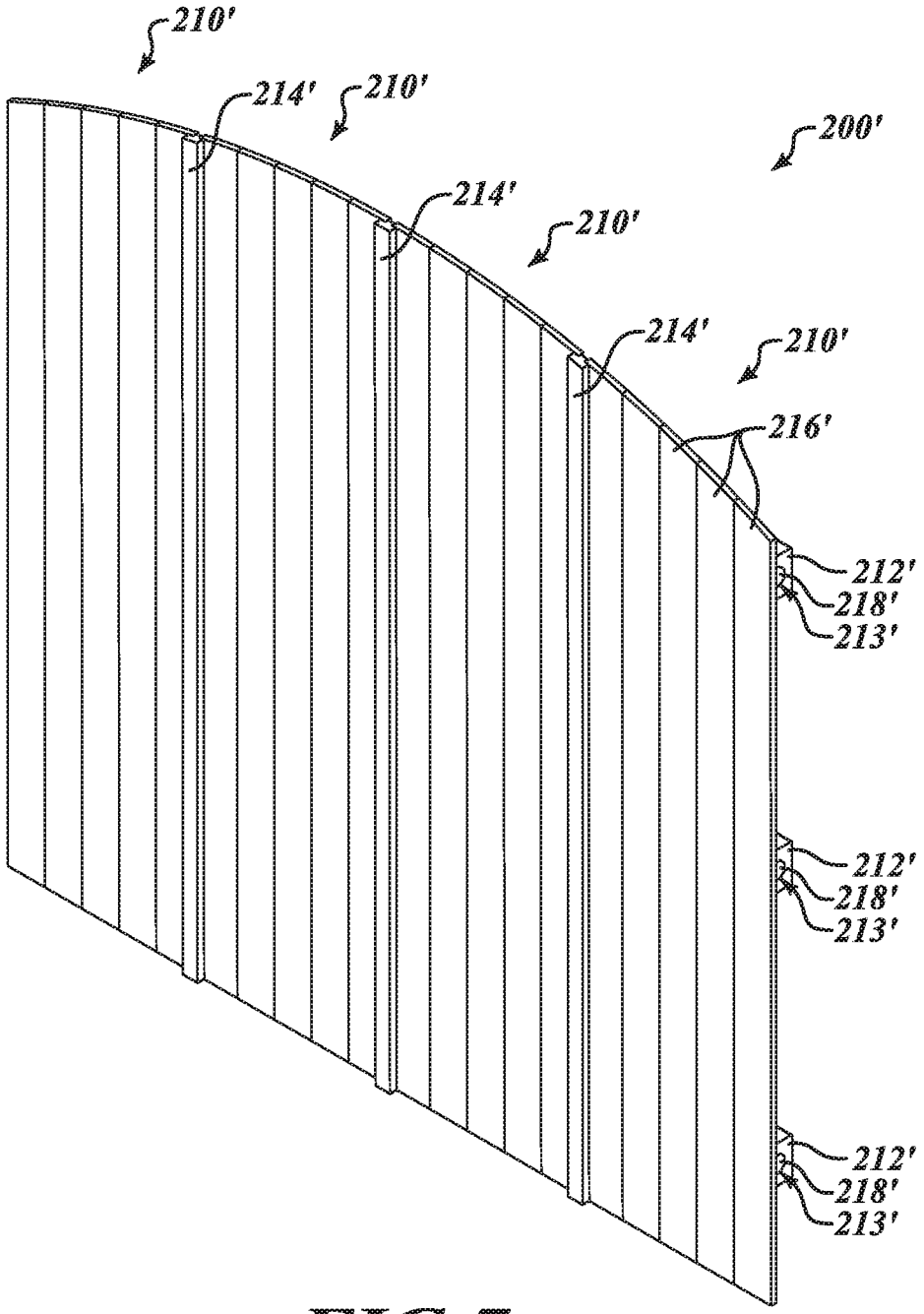
FIG. 7 shows a fence panel, according to another embodiment, that is constructible from a collection of fence components similar to those shown in FIGS. 2 and 3.

For example, FIG. 7 shows another embodiment of a fence panel 200', which is similar in construction to the fence panel 200 shown in FIGS. 5 through 6A, but which includes a convex upper profile. Similar to fence panel 200, the fence panel 200' of FIG. 7 includes: sub-panel assemblies 210', panel rails 212', and sub-panel assembly spacers 214'. Each of the sub-panel assemblies 210' include a series of sub-panel rails 218' that are fastened to fence boards 216' to hold the fence boards 216' together. The sub-panel assemblies 210' are positioned next to each other in a linear series such that the sub-panel rails 218' of each sub-panel assembly 210' align with each other. In addition, a respective sub-panel assembly spacer 214' is positioned between each adjacent pair of the sub-panel assemblies 210'. Each of the panel rails 212' is positioned to insertably receive, or to otherwise engage or abut, the linear arrangements of the sub-panel rails 218' formed by the end-to-end linear arrangement of the sub-panel assemblies 210' to assist in ensuring the sub-panel assemblies 210' are properly aligned relative to each other and to assist in fixing the sub-panel assemblies 210' in space relative to each other. The panel rails 212' are fixed to the sub-panel assemblies 210' and to the sub-panel assembly spacers 214' by suitable fixing techniques (e.g., mechanical fasteners). Each of the panel rails 212' includes an elongate rail cavity 213' having a cross-sectional profile that is sized and shaped to insertably receive the respective linear arrangement of the sub-panel rails 218'. The fence boards 216' vary in length and end profile such that they collectively define a fence panel 200' having a convex upper profile. The sub-panel assembly spacers 214' may also vary in length in accordance with the profile of the fence panel 200'.

Figure 8:
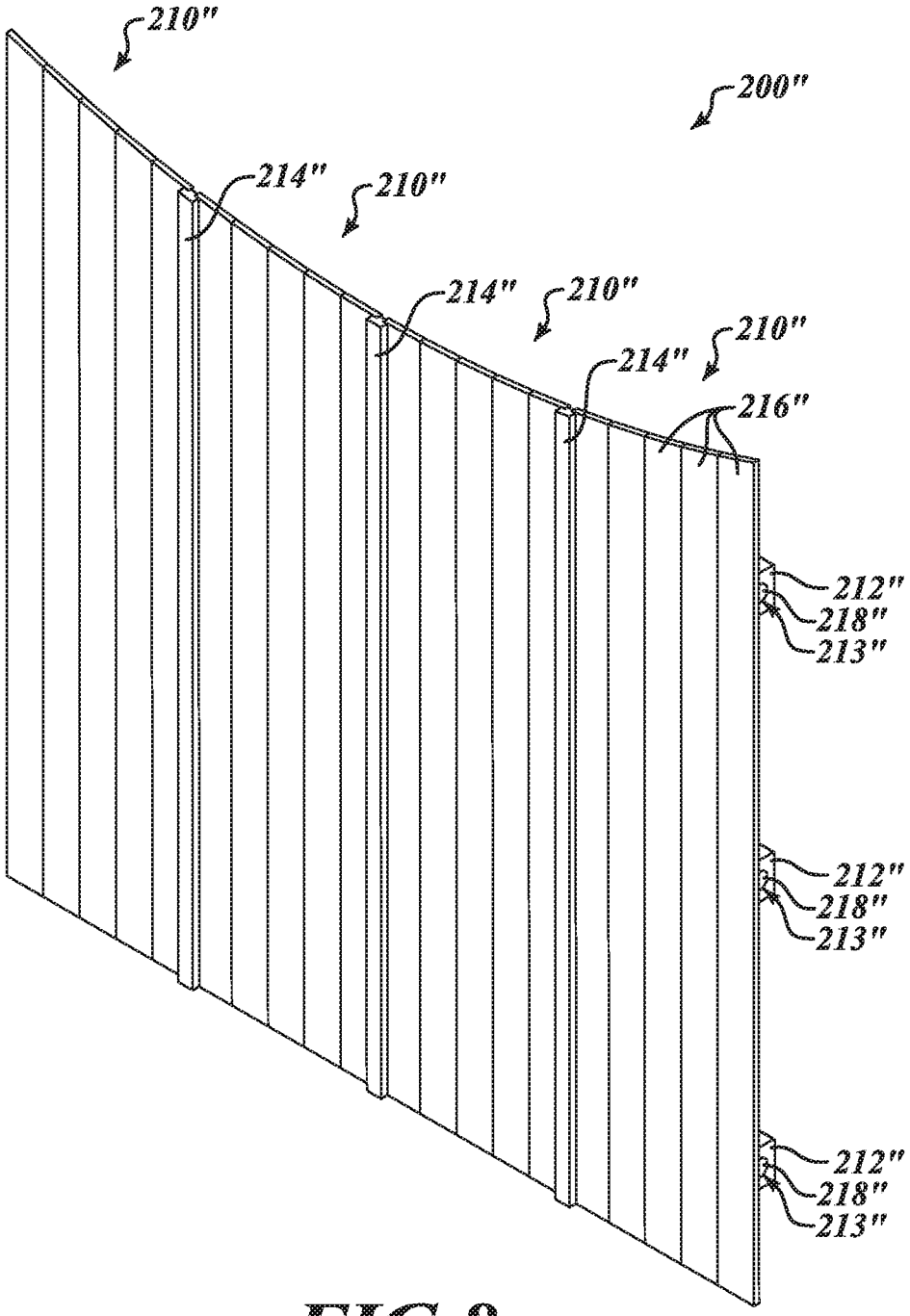
FIG. 8 shows a fence panel, according to yet another embodiment, that is constructible from a collection of fence components similar to those shown in FIGS. 2 and 3.

As another example, FIG. 8 shows yet another embodiment of a fence panel 200" which is similar in construction to the fence panel 200 shown in FIGS. 5 through 6A, but which includes a concave upper profile. Similar to fence panel 200, the fence panel 200" of FIG. 8 includes: sub-panel assemblies 210", panel rails 212", and sub-panel assembly spacers 214". Each of the sub-panel assemblies 210" include a series of sub-panel rails 218" that are fastened to fence boards 216" to hold the fence boards 216" together. The sub-panel assemblies 210" are positioned next to each other in a linear series such that the sub-panel rails 218" of each sub-panel assembly 210" align with each other. In addition, a respective sub-panel assembly spacer 214" is positioned between each adjacent pair of the sub-panel assemblies 210". Each of the panel rails 212" is positioned to insertably receive, or to otherwise engage or abut, the linear arrangements of the sub-panel rails 218" formed by the end-to-end linear arrangement of the sub-panel assemblies 210" to assist in ensuring the sub-panel assemblies 210" are properly aligned relative to each other and to assist in fixing the sub-panel assemblies 210" in space relative to each other. The panel rails 212" are fixed to the sub-panel assemblies 210" and to the sub-panel assembly spacers 214" by suitable fixing techniques (e.g., mechanical fasteners). Each of the panel rails 212" includes an elongate rail cavity 213" having a cross-sectional profile that is sized and shaped to insertably receive the respective linear arrangement of the sub-panel rails 218". The fence boards 216" vary in length and end profile such that they collectively define a fence panel 200" having a concave upper profile. The sub-panel assembly spacers 214" may also vary in length in accordance with the profile of the fence panel 200".

In accordance with aspects of the fence panels 200, 200', 200" described herein, a method of constructing a fence panel 200, 200', 200" may include assembling a fence panel 200, 200', 200" from a plurality of fence panel components including a plurality of sub-panel assemblies 210, 210', 210", a plurality of panel rails 212, 212', 212", and a plurality of sub-panel assembly spacers 214, 214', 214", wherein each sub-panel assembly 210, 210', 210" includes a plurality of fence boards 216, 216', 216" coupled together in series by a plurality of sub-panel rails 218, 218', 218" extending between opposing lateral ends of the sub-panel assembly 210, 210', 210". The assembling may include: arranging the plurality of sub-panel assemblies 210, 210', 210" in a linear arrangement with a respective sub-panel assembly spacer 214, 214', 214" between adjacent sub-panel assemblies 210, 210', 210" and with the sub-panel rails 218, 218', 218" from each sub-panel assembly 210, 210', 210" aligned in linear arrangements; positioning each panel rail 212, 212', 212" to insertably receive a respective linear arrangement of the sub-panel rails 218, 218', 218" of the sub-panel assemblies 210, 210', 210"; and securing the panel rails 212, 212', 212' to the sub-panel assemblies 210, 210', 210". Securing the panel rails 212, 212', 212" to the sub-panel assemblies may include fastening the panel rails 212, 212', 212" to the fence boards 216, 216', 216" and/or the sub-panel rails 218, 218', 218" of the sub-panel assemblies 210, 210', 210". Positioning each panel rail 212, 212', 212" to insertably receive a respective linear arrangement of the sub-panel rails 218, 218', 218" of the sub-panel assemblies 210, 210', 210" may include readjusting one or more of the plurality of sub-panel assemblies 210, 210', 210" relative to the panel rail 212, 212', 212" such that each of the sub-panel rails 218, 218', 218" align with a cavity 213, 213', 213" formed in the panel rail 212, 212', 212". The cavity 213, 213', 213" may have a cross-sectional profile that is sized and shaped to insertably receive the sub-panel rails 218, 218', 218", and positioning each panel rail 212, 212', 212" to insertably receive the respective linear arrangement of sub-panel rails 218, 218', 218" may include nesting the sub-panel rails 218, 218', 218" within the cavity 213, 213', 213" of the panel rail 212, 212', 212". The method may further include securing the panel rails 212, 212', 212" to the sub-panel assembly spacers 214, 214', 214" with a gap provided therebetween. In some instances, the fence panel 200, 200', 200" may be assembled to include an exterior face, and assembling the fence panel 200, 200', 200" may be completed without extending a fastener through the exterior face.

Again, in accordance with one or more embodiments, the components of a fence panel can be referred to collectively as a fence panel kit. A fence panel kit can be packaged in various ways for storage and transportation from a manufacturing or packaging location to an installation location or other location, such as, for example, home improvement and hardware stores for sale to individual consumers, contractors, fence builders or others. In some embodiments, a fence panel kit can include a plurality of fence panel components, such as the densely packed arrangement of fence panel components 201 shown in FIGS. 2 and 3, packaged within external packaging such as, for example, corrugated paperboard, plastic wrap (e.g., shrink wrap), or metal or plastic strapping, to form a single packaged arrangement of fence panel components. Again, in some embodiments, the densely packed arrangement may include or consist of: the sub-panel assemblies 210, the panel rails 212 and the sub-panel assembly spacers 214, with each of these components disconnected from one another in the single packaged arrangement. Fasteners may also be included such that an entirety of a fence panel can be constructed or erected from the single packaged arrangement. Additionally, spacer blocks, such as blocks 215 shown in FIGS. 2 and 3, may be provided to assist in bundling the components in a densely packed arrangement 201, but may not be required or needed to form the resultant fence panel (e.g., fence panel 200).

Again, FIGS. 2 through 3 show one particularly efficient arrangement of the sub-panel assemblies 210, the panel rails 212 and the sub-panel assembly spacers 214. In particular, the sub-panel assemblies 210 are shown stacked in offset pairs that are arranged with the sub-panel rails 218 facing each other. The panel rails 212 and sub-panel assembly spacers 214 are arranged vertically against an exterior face of one of the sub-panel assemblies 210 within the confines of the width of the sub-panel assemblies 210. In this manner, the fence panel components may be arranged within a rectangular reference prism having a width W equal to a width of the sub-panel assemblies 210. The rectangular reference prism may also have a height H equal to a length of the panel rails 212 (or longest panel rail 212) and a depth D equal to a collective thickness of one of the panel rails 212, two of the sub-panel assemblies 210 and two fence boards 216 of the sub-panel assemblies 210.

Any of the fence panel components described herein can be fabricated from any suitable material or materials, such as various wood materials, plastic materials, vinyl, or metal materials. The fence panels and fence panel components described herein can have any suitable dimensions. In some instances, the fence boards 216, 216', 216" may be formed by: sawing standard 2×4 (1.5"×3.5") lumber in half to approximately 11/16"×3.5"; passing the boards through a molder to apply a desired texture; and staining the boards to replicate cedar fence boards or other varieties of fence boards.

Although embodiments of the fence panels 200, 200', 200" shown and described herein are shown as including four separate sub-panel assemblies 210, 210', 210", each with five vertically oriented fence boards 216, 216', 216" fixed together with three horizontal sub-panel rails 218, 218', 218", three horizontal panel rails 218, 218', 218", and three intermediate sub-panel assembly spacers 214, 214', 214", it is appreciated that the number of such fence components may be more or less than those illustrated in the figures. As an example, a sub-panel assembly having three 5.5" wide fence boards may be provided instead with five 3.5" wide fence boards. As another example, a fence panel may include three or five sub-panel assemblies, rather than four sub-panel assemblies as illustrated in the figures.

Moreover, various features and aspects of the embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A fence panel comprising:

a plurality of sub-panel assemblies positioned in a linear arrangement, each sub-panel assembly including a plurality of fence boards coupled together side-by-side in series by a plurality of sub-panel rails oriented transverse to the fence boards and positioned against an exterior side of the fence boards, the sub-panel rails extending between opposing lateral ends of each sub-panel assembly; and a plurality of panel rails each having a length that corresponds to an overall width of the fence panel, and each panel rail including an elongate cavity within which respective sub-panel rails of the sub-panel assemblies are insertably received.

2. The fence panel of claim 1 wherein the elongate cavity is formed in a face of the panel rail to provide a panel rail having a cross-sectional profile that is generally U-shaped.

3. The fence panel of claim 1 wherein the fence boards of each sub-panel assembly are positioned next to each other in a non-overlapping manner and are secured together via the sub-panel rails and a plurality of fasteners extending through an interface between the fence boards and the sub-panel rails.

4. The fence panel of claim 3 wherein the fasteners do not protrude through exterior faces of the fence boards.

5. The fence panel of claim 1, further comprising:

a respective sub-panel assembly spacer positioned between adjacent ones of the sub-panel assemblies that separate the sub-panel assemblies from each other.

6. The fence panel of claim 5 wherein each sub-panel assembly spacer includes a protruding portion that physically separates the adjacent sub-panel assemblies from each other.

7. The fence panel of claim 6 wherein each sub-panel assembly spacer is configured to abut a respective exterior face of each of adjacent end fence boards of the adjacent sub-panel assemblies at a mating interface and wherein the protruding portion of the sub-panel assembly spacer protrudes a distance from the mating interface that is less than a thickness of the adjacent end fence boards.

8. The fence panel of claim 7 wherein a cross-sectional profile of the sub-panel assembly spacer is generally T-shaped.

9. The fence panel of claim 5 wherein the fence panel is constructible from a kit consisting of a single packaged arrangement of fence panel components comprising the sub-panel assemblies, the sub-panel assembly spacers and the panel rails.

10. A fence panel kit for constructing a fence panel to be installed between adjacent fence posts, the fence panel kit comprising:

one or more packages containing an arrangement of fence panel components, the arrangement including:

a plurality of sub-panel assemblies each having a plurality of fence boards coupled together side-by-side in series by a plurality of sub-panel rails oriented transverse to the fence boards and positioned against an exterior side of the fence boards; and a plurality of panel rails, each panel rail including an elongate cavity that is configured to insertably receive respective sub-panel rails of each of the sub-panel assemblies, wherein each of the sub-panel assemblies and the panel rails are disconnected from one another for storage and transport in the one or more packages, and wherein the fence panel components are constructible into a fence panel in which the sub-panel rails are received within the panel rails.

11. The fence panel kit of claim 10 wherein the elongate cavity is formed in a face of the panel rail to provide a panel rail having a cross-sectional profile that is generally U-shaped.

12. The fence panel kit of claim 10 wherein the fence boards of each sub-panel assembly are positioned next to each other in a non-overlapping manner and are secured together via the sub-panel rails and a plurality of fasteners extending through an interface between the fence boards and the sub-panel rails.

13. The fence panel kit of claim 12 wherein the fasteners do not protrude through exterior faces of the fence boards.

14. The fence panel kit of claim 10 wherein the arrangement of fence panel components further includes a plurality of sub-panel assembly spacers, and wherein the fence panel components are constructible such that adjacent sub-panel assemblies of the fence panel are separated by a respective one of the sub-panel assembly spacers.

15. The fence panel kit of claim 14 wherein each sub-panel assembly spacer is configured to be positioned between a pair of adjacent sub-panel assemblies with a protruding portion of the sub-panel assembly spacer physically separating the sub-panel assemblies from each other.

16. The fence panel kit of claim 15 wherein each sub-panel assembly spacer is configured to abut a respective exterior face of each of adjacent end fence boards of the adjacent sub-panel assemblies at a mating interface and wherein the protruding portion of the sub-panel assembly spacer protrudes a distance from the mating interface that is less than a thickness of the adjacent end fence boards.

17. The fence panel kit of claim 16 wherein a cross-sectional profile of the sub-panel assembly spacer is generally T-shaped.

18. The fence panel kit of claim 10 wherein the fence panel kit consists of a single package of the arrangement and wherein the fence panel components are arranged within a rectangular reference prism having a width equal to a width of the sub-panel assemblies.

19. The fence panel kit of claim 18 wherein the rectangular reference prism has a depth equal to a collective thickness of one of the panel rails, two of the sub-panel assemblies and two fence boards of the sub-panel assemblies.

20. The fence panel kit of claim 19 wherein the rectangular reference prism has a height equal to a length of the panel rails.

21. A method of constructing a fence panel, the method comprising:

assembling a fence panel from a plurality of fence panel components including:

a plurality of sub-panel assemblies each having a plurality of fence boards coupled together side-by-side in series by a plurality of sub-panel rails oriented transverse to the fence boards and positioned against an exterior side of the fence boards; and a plurality of panel rails, each panel rail including an elongate cavity that is configured to insertably receive respective sub-panel rails of each of the sub-panel assemblies, wherein the assembling includes:

arranging the plurality of sub-panel assemblies in a linear arrangement with the sub-panel rails from each sub-panel assembly aligned in linear arrangements;

positioning each panel rail to insertably receive a respective linear arrangement of the sub-panel rails of the sub-panel assemblies; and securing the panel rails to the sub-panel assemblies.

22. The method of claim 21 wherein securing the panel rails to the sub-panel assemblies includes fastening the panel rails to the fence boards and/or the sub-panel rails of the sub-panel assemblies.

23. The method of claim 21 wherein positioning each panel rail to insertably receive the respective linear arrangement of the sub-panel rails of the sub-panel assemblies includes readjusting one or more of the plurality of sub-panel assemblies relative to the panel rail such that each of the sub-panel rails align with a cavity formed in the panel rail.

24. The method of claim 21 wherein each panel rail includes an elongate cavity having a cross-sectional profile that is sized and shaped to insertably receive the sub-panel rails, and wherein positioning each panel rail to insertably receive the respective linear arrangement of the sub-panel rails includes nesting the sub-panel rails within the elongate cavity of the panel rail.

25. The method of claim 21 wherein the assembling includes arranging the plurality of sub-panel assemblies in the linear arrangement with a respective sub-panel assembly spacer positioned between adjacent sub-panel assemblies.

26. The method of claim 25 further comprising securing the panel rails to the sub-panel assembly spacers with a gap provided therebetween.

27. The method of claim 21 wherein the fence panel is assembled to include an exterior face, and wherein assembling the fence panel is completed without extending a fastener into or through the exterior face.

* * * * *